US005337889A

United States Patent [19]

Chan

[11] Patent Number: 5,337,889

[45] Date of Patent: Aug. 16, 1994

[54] DUAL POCKET DISPLAY FOLDER FOR SHEET MATERIAL

[76] Inventor: Michael L. F. Chan, 1407 Arch St., Berkeley, Calif. 94708

[21] Appl. No.: 92,253

[22] Filed: Jul. 14, 1993

[51] Int. Cl.[5] ..... B65D 85/00

[52] U.S. Cl. ..... 206/215; 206/232; 206/49; 206/495; 206/449; 229/75

[58] Field of Search ..... 206/49, 215, 232, 311, 206/449, 494, 495; 229/75, 87.10, 87.19

[56] References Cited

U.S. PATENT DOCUMENTS

| | | | |
|---|---|---|---|
| 9,185 | 5/1880 | Pulaski | 206/49 |
| 9,641 | 4/1881 | Mason | 206/49 |
| 317,604 | 5/1885 | Woodley | 206/49 |
| 518,189 | 4/1894 | McFall | 229/75 |
| 685,021 | 10/1901 | Waslyng | 229/75 |
| 1,294,481 | 2/1919 | Kopec | 229/75 |
| 1,368,963 | 2/1921 | Obici | 229/75 |
| 1,931,022 | 10/1933 | Ewerlof | 206/494 |
| 2,241,673 | 5/1941 | Mogabgab | 206/215 |
| 2,242,737 | 5/1941 | Alfreds | 206/215 |
| 2,330,457 | 9/1943 | Tremblett | 206/215 |
| 2,550,285 | 4/1951 | Mishkin | 206/494 |
| 3,366,313 | 1/1968 | Culberg et al. | 229/87.19 |
| 3,870,223 | 3/1975 | Wyant | 206/215 |
| 4,064,990 | 12/1977 | Bennett | 206/215 |
| 4,177,898 | 12/1979 | Humphrey | 206/494 |
| 5,060,793 | 10/1991 | Hyun et al. | 206/232 |
| 5,251,759 | 10/1993 | Gannon et al. | 206/232 |

*Primary Examiner*—David T. Fidei
*Attorney, Agent, or Firm*—Murray Francy

[57] ABSTRACT

A package to display paper items having a rigid panel for reinforcing the items and a display folder with a pair of pockets for receiving the reinforced items. The folder has two partially overlapping pockets with diagonally oriented openings which are in oblique facing relation to one another. The package is assembled by inserting the item, backed by the reinforcing panel, into one of the pockets of the folder. The front pocket surface of the folder defines a uniformly colored triangular field to which a contrastingly colored decorative object is affixed. The diagonally bordered field and contrasting decorative object enhance the visibility of large irregularly patterned items inserted in the front pocket. Smaller display items are placed in staggered overlapping arrangement against the reinforcing panel and inserted in the rear pocket of the folder. In this configuration, the decorative object is centrally located at the intersection of the pocket openings. The folder is assembled from a single stiff paper blank containing a number of score lines along which it is folded. The assembled folder's shape is maintained by interlocking panels without the use of adhesive.

13 Claims, 4 Drawing Sheets

DUAL POCKET DISPLAY FOLDER FOR SHEET MATERIAL

FIELD OF INVENTION

The invention relates generally to display packaging for sheet-material items such as decorative cards, note paper and the like, and more particularly, to a dual-pocket display folder.

BACKGROUND ART

Sheet-material items, such as cards, paper and the like, are generally packaged to display their contents for inspection by consumers in retail establishments. Frequently, they are displayed adjacent to other similar items which compete for the consumer's attention. Greeting, or decorative, note cards are generally loosely displayed in racks with the card faces visible for consumer inspection.

Items having irregular patterns composed of similar colors on their surface, while pleasing to the eye on close inspection, fail to attract the consumer's attention when a large display of similar items is scanned. The human visual system is organized to respond to contrasting patterns in the visual field. For example, there are neurons in the visual cortex which only respond to lines at specific angles in the visual field. Irregularly shaped patterns thus have a tendency to fade into the visual background.

An additional problem with conventional card packaging is the lack of support for the card when it is removed from the display rack. The unsupported cards are subject to damage by creasing during handling, replacement in the display rack, or while being carried in conventional plastic or paper bags following purchase.

It is therefore an object of the present invention to provide an improved display package for cards or other sheet-material items which enhances the item's visibility.

It is a further object to provide an improved display package which protects the item from damage during handling and transport.

SUMMARY OF THE INVENTION

Briefly, the present invention includes a novel display package for cards or other sheet-material items which enhances the visibility of the item in a retail environment by juxtaposing the item with a uniformly colored triangular field containing a contrastingly colored decorative object. The field is located on the front surface of a rectangular display folder having a pair of partially overlapping pockets. The pockets have diagonally oriented openings which are in oblique facing relation to one another. The package also includes a flat, rectangular reinforcing support which is coextensive with the displayed item. The package is assembled by inserting the item, backed by the reinforcing support, into one of the pockets of the folder.

In one preferred embodiment, the item and support are inserted into the front pocket, providing a diagonally oriented contrast line between the display item and the decorative object. The decorative object may be adhesively affixed to the front surface of the folder or may be removably attached. The method of attachment will vary, depending upon the nature of the decorative object. In an alternate preferred embodiment, a number of smaller display items are placed in staggered overlapping arrangement against the support and inserted in the rear pocket of the folder. These items are displayed against a V-shaped field, and a decorative object is centrally placed at the intersection of the pocket openings.

In a preferred form, the folder is formed from a single blank of stiff paper or other flexible, formable material. The blank is rectangular in shape, with a length approximately four times its width. The blank contains a number of score lines along which it is folded. The folder is assembled without the use of adhesive and maintains its assembled shape through an interlocking relation of its panels.

An advantage of the display package of the present invention is enhanced visibility of the displayed item.

Another advantage is that the display package protects the item from damage during handling and transport.

BEST MODE FOR CARRYING OUT THE INVENTION

Figure 1:
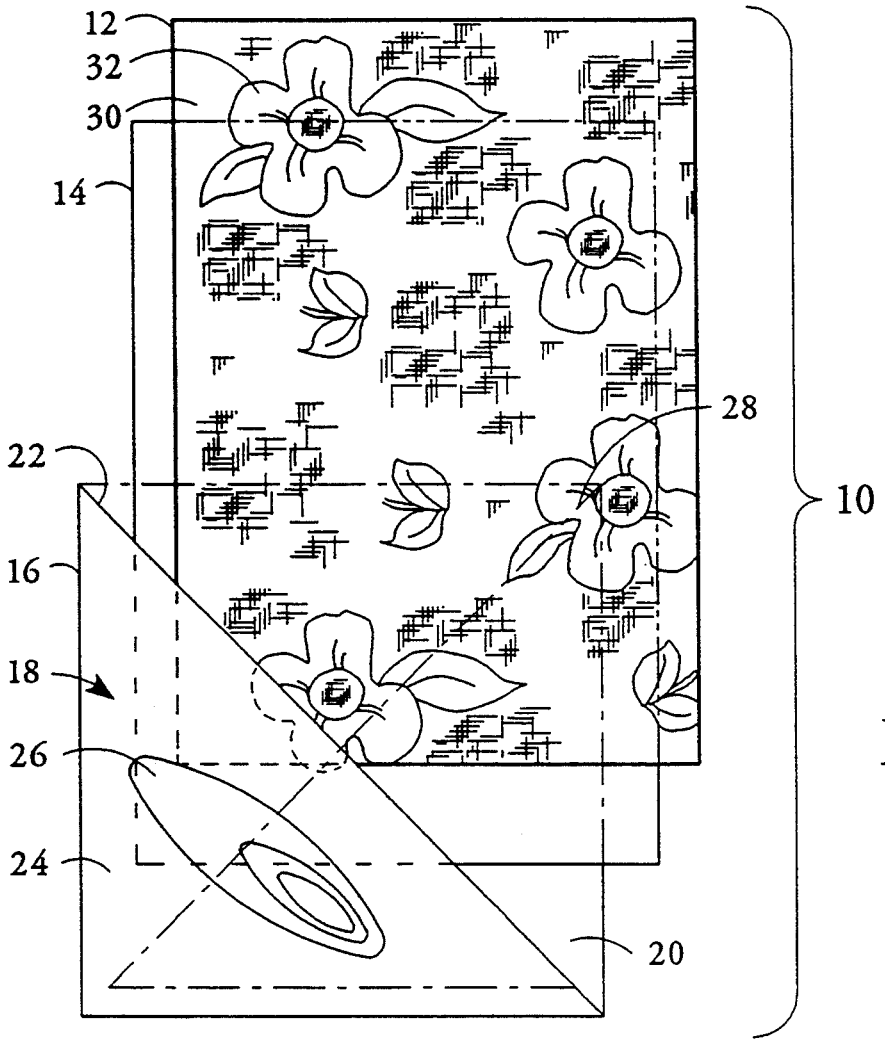
FIG. 1 is an exploded front view of a display package which is designed in accordance with the present invention.

With reference to FIG. 1, an exploded front view of a display package 10 according to the present invention is shown. Package 10 includes a display item 12, a coextensive reinforcing support 14 and a display folder 16. Folder 16 has a pair of partially overlapping triangular-shaped pockets 18 and 20. Front pocket 18 has a diagonally oriented, upwardly facing opening 22 and an outside front surface 24. A decorative object 26 is affixed to surface 24. Rear pocket 20 has a diagonally oriented opening 28 which is in oblique facing relation to front pocket opening 22.

Item 12 has a colored surface 30 which contains an irregular pattern 32. Folder 16 is generally constructed of a stiff paper material which has a uniform color complimentary to surface 30. Decorative object 26, however, is chosen to have a shape and color which contrast with surface 30 and pattern 32.

Display package 10 is assembled by inserting display item 12, backed by reinforcing support 14, into front pocket 18 of folder 16. The visual contrast between uniformly colored surface 24, contrastingly colored object 26 and pattern display item 12 greatly enhances the visibility of display package 10.

Referring now to FIGS. 2*a–f,* folder 16 is preferably assembled from a stiff paper blank 40, which has two back sections, two front sections and two tab sections. Other flexible formable materials such as cardboard or plastic may also be employed. The two back sections are inside and outside back panels 42 and 48, the two front sections are inside and outside front panels 44 and 46 and the two tab sections are front and back tab panels 52 and 50. The terms front, back, top, bottom and side refer to position in the final assembled folder depicted in FIG. 2*f*.

Inside back panel 42 is defined in the longitudinal direction by the separation between parallel top edge 54 and bottom score line 56. Inside back panel 42 is defined in the lateral direction by first side edge 58 and second side edge 60 which connect edge 54 and line 56.

Inside front panel 44 is triangular in shape and extends from inside back panel 42 at bottom score line 56 to first diagonal score line 62, and is further defined by third side edge 64. The length of third side edge 64 is substantially equal to the length of first side edge 58.

Outside front panel 46 is triangular in shape and extends from inside front panel 44 at first diagonal score line 62 to first side score line 66, and is further defined by first bottom edge 68. It is preferred that first side score line 66 be parallel to first bottom score line 56. Outside front panel 46 is substantially equal in area to inside front panel 44.

Outside back panel 48 is rectangular in shape and extends from outside front panel 46 at first side score line 66 to second side score line 70, and is further defined by second bottom edge 72 and second top edge 74. It is preferred that second side score line 70 be parallel to first side score line 66 and that second bottom edge 72 and second top edge 74 be slightly longer in length than first top edge 54 and bottom score line 56.

Front tab panel 50 is triangular in shape and extends from outside back panel 48 at second side score line 70 to second diagonal score line 76, and is further defined by third bottom edge 78. Front tab panel 50 is slightly smaller in area than front panels 44 and 46.

Back tab panel 52 is triangular in shape and extends from front tab panel 50 at second diagonal score line 76 to fourth bottom edge 80, and is further defined by fourth side edge 82. Back tab panel 52 is slightly smaller in area than front tab panel 50.

Figure 2A:
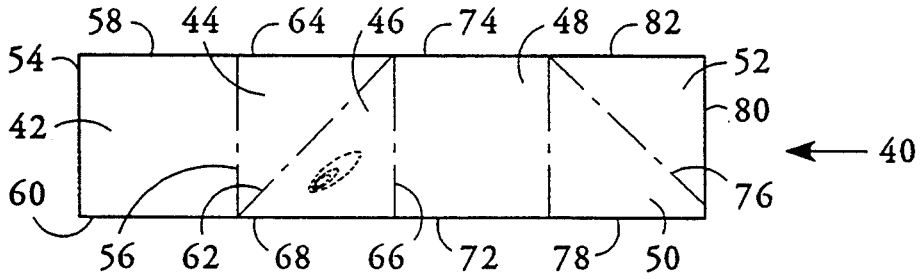
FIGS. 2*a–f* are sequential plan views of a dual-pocket folder being assembled from a blank.
Figure 2B:
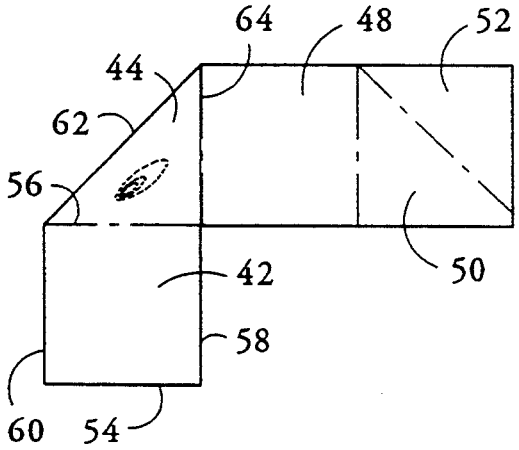

Referring now to FIG. 2*b*, the first step in assembly is to fold blank 40 along first diagonal score line 62 placing inside front panel 44 adjacent to outside front panel 46 in coextensive overlapping relation such that second side edge 64 is adjacent to first score line 66. The direction in which the fold is made along score line 62 determines which side the front pocket opening in the assembled folder will face.

Figure 2C:
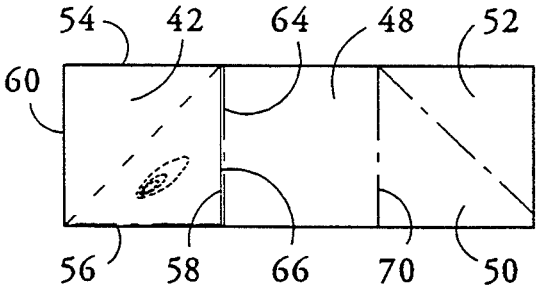
Figure 2D:
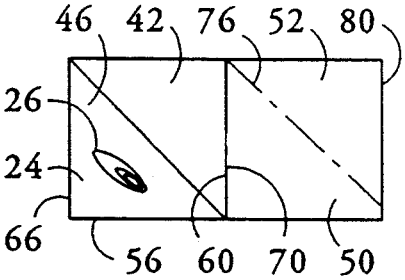

Referring now to FIG. 2*c*, inside back panel 42 is folded toward inside front panel 44 along bottom score line 56 placing first side edge 58 adjacent to second side edge 64 and first side score line 66. Inside back panel 42 is then placed adjacent to outside back panel 48 by folding along first side score line 66. As illustrated in FIG. 2*d*, second side edge 60 is adjacent to second side score line 70 and outside front surface 24 of outside front panel 46, with attached decorative object 26, is now visible.

Figure 2E:
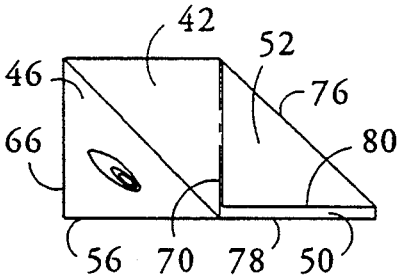
Figure 2F:
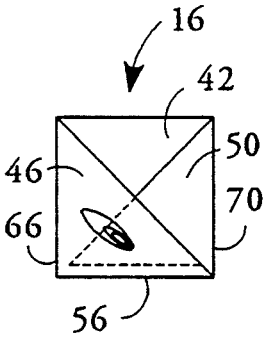

Assembly is completed by folding back tab panel 52 toward front tab panel 50 along second diagonal score line 76 and then inserting front and back tab panels 50 and 52 between inside front panel 44, not shown, and inside back panel 42 by folding along second side score line 70 as illustrated in FIGS. 2*e–f*. In assembled folder 16, third bottom edge 78 and fourth bottom edge 80 are adjacent to bottom score line 56. The interlocking relation of tab panels 50 and 52 with inside front panel 44 and inside back panel 42 maintains folder 16 in its assembled configuration without adhesives.

Figure 3A:
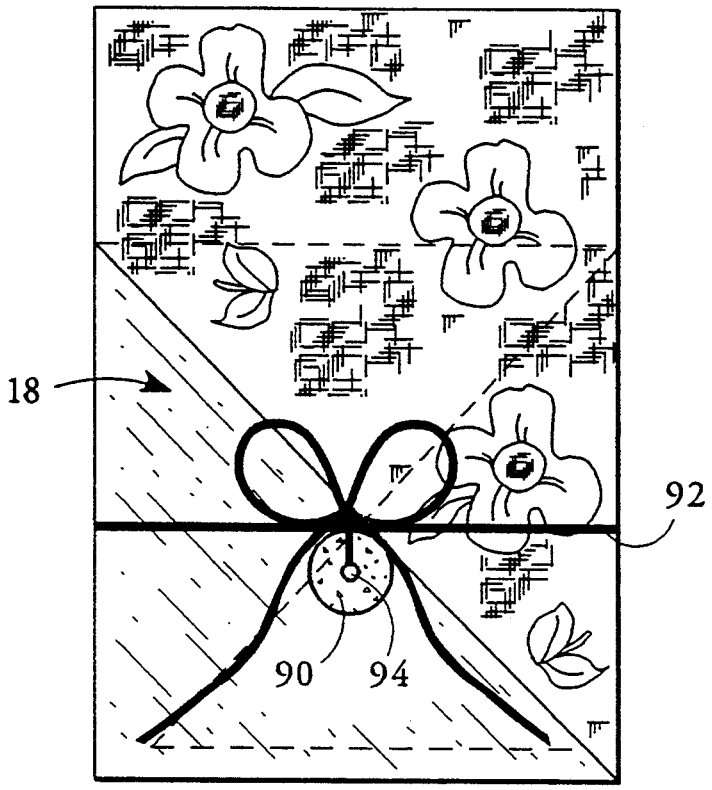
FIG. 3*a* is a front view of a display package having a decorative object removably attached via a ribbon.
Figure 3B:
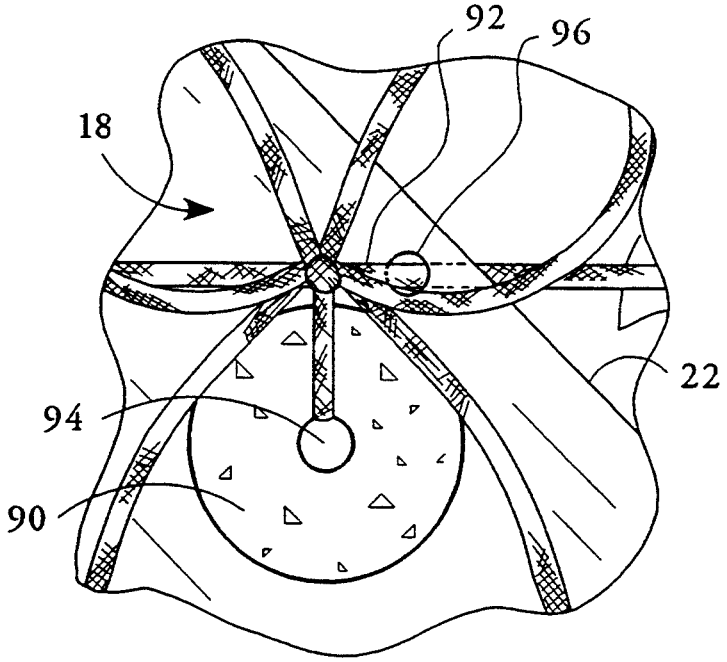
FIG. 3*b* is an enlarged cut-away view of the attachment configuration of FIG. 3*a;*

FIG. 3*a* illustrates a second preferred embodiment in which a decorative object 90 is removably attached to front pocket 18 via a decorative ribbon 92. Decorative object 90 may be any contrastingly colored object, such as a polished stone, which is capable of being secured with ribbon 92. In one preferred embodiment, decorative object 90 has a centrally located hole 94 through which ribbon 92 passes. As shown in FIG. 3*b*, decorative object 90 is attached to pocket 18 by passing ribbon 92 through a cutout hole 96 adjacent to opening 22 of pocket 18.

Figure 4A:
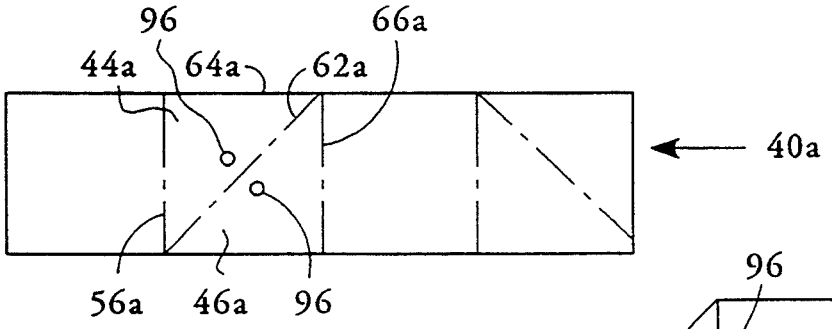
FIGS. 4*a–b* illustrate the partial assembly of the folder of FIGS. 3*a–b* using a blank having cutout holes.
Figure 4B:
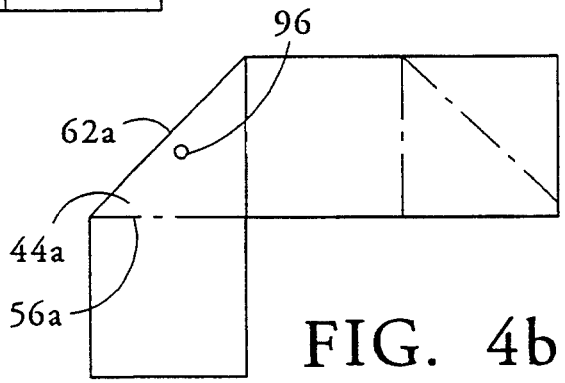

Referring now to FIGS. 4*a–b*, a blank **40*a*** for assembling the folder depicted in FIGS. 3*a–b* is shown. Blank **40*a* is identical to blank 40** depicted in FIGS. 2*a–f* except for the addition of a pair of cutout holes 96 to front panels **44*a* and 46*a*. Cutout holes 96 are symmetrically located adjacent to first diagonal score line 62*a* along a line perpendicular to score line 62*a*. When inside front panel 44*a* is folded toward outside front panel 46*a* along first diagonal score line 62*a*, cutout holes 96** are coextensively aligned as illustrated in FIG. 4*b*. The remaining assembly steps are identical to those described above in reference to FIGS. 2*a–f*.

Figure 5:
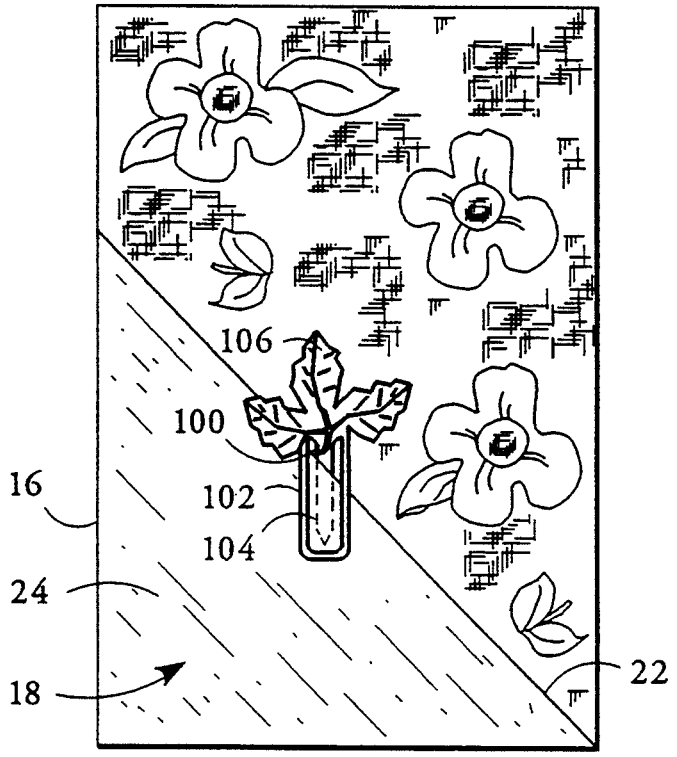
FIG. 5 is a front view of an alternate embodiment of the display package in which a decorative bookmark is removably attached.

With reference to FIG. 5, a further preferred embodiment in which a decorative bookmark 100 is removably attached to folder 16 is illustrated. The attachment portion of bookmark 100 consists of a flat substantially rectangular outer strip 102 surrounding a flat inwardly extending tab 104 attached to one end of strip 102. A decorative FIG. 106, such as a leaf or bird, extends outwardly from the end of strip 102 where tab 104 is attached. In operation, strip 102 frictionally engages front outer surface 24 of pocket 18 while tab 104 frictionally engages the inner front surface of pocket 18.

Figure 6:
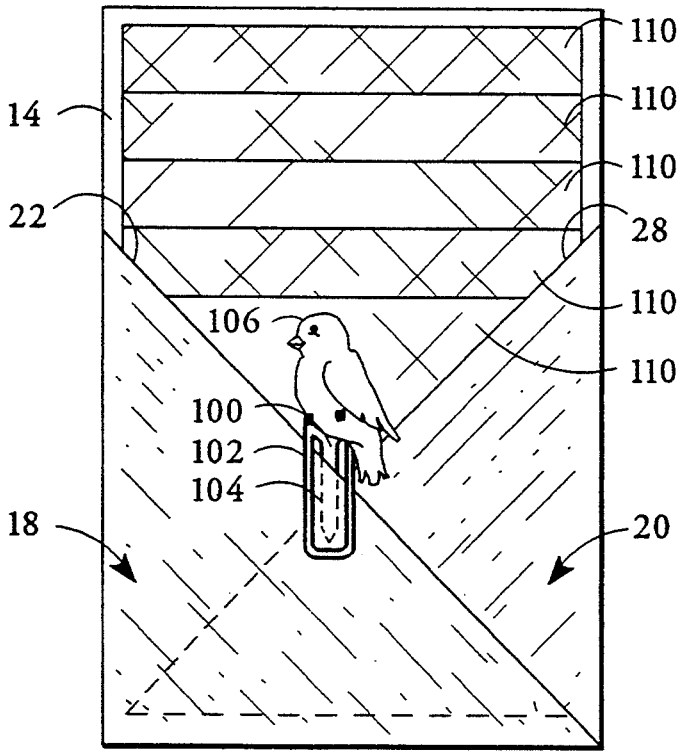
FIG. 6 is a front view of an alternate embodiment of the display package in which items are inserted into the rear pocket for display.

Referring now to FIG. 6, an alternate preferred embodiment in which items to be displayed are placed in rear pocket 20 is illustrated. A number of display items 110 are overlaid on reinforcing support 14 in partially overlapping relation and inserted in opening 28 of rear pocket 20. Decorative bookmark 100 is centrally located at the intersection of pocket openings 22 and 28 with tab 104 frictionally engaging the front inner surfaces of both pocket 18 and pocket 20. It is preferred that the upper edges 112 of items 110 be evenly spaced apart and substantially parallel to one another although any other configuration exhibiting sufficient visual contrast between items 110 may also be employed.

I claim:

1. A display package comprising:

a sheet material item;

a substantially rigid panel having opposed major surfaces and a peripheral edge for reinforcing the sheet-material item;

a rectangular folder having at least one pocket for reception of the sheet-material item and reinforcing panel, said pocket having a front outside surface and a substantially upward facing opening with a diagonally oriented front edge, the area bounded by said pocket being substantially smaller than the surface area of said reinforcing panel, whereby a diagonally bordered portion of said sheet-material is displayed by said package, wherein said sheet-material has a patterned surface and said folder has a uniformly colored surface, said display package further comprising a decorative object affixed to the front outside surface of said pocket, wherein said decorative object and said front pocket surface are connected with a ribbon material, wherein said decorative object is removably attached.

2. A dual-pocket display folder for sheet material comprising:

a) a triangular outside front panel defined by a first vertical score line, a first diagonal score line and a first bottom edge;

b) a triangular inside front panel connected to the outside front panel at the first diagonal score line, and further defined by a bottom score line and a first vertical edge, the bottom score line being parallel to the bottom edge of the outside front panel;

c) a rectangular inside back panel connected to the inside front panel at the bottom score line, and further defined by a first top edge parallel to the bottom score line and parallel side edges transverse of the bottom score line and first top edge;

d) a rectangular outside back panel connected to the outside front panel at the first vertical score line, and further defined by a second vertical score line parallel to the first vertical score line and parallel second top and second bottom edges transverse of the first and second vertical score lines, the outside back panel further being adjacent to and coextensive with the inside back panel;

e) a triangular tab front panel connected to the outside back panel at the second vertical score line, and further defined by a third bottom edge and a second diagonal score line;

f) a triangular tab back panel connected to the front tab panel at the second diagonal score line, and further defined by a second vertical edge and a fourth bottom edge; and g) the front and back tab panels each being co-parallel with and disposed between the inside front panel and inside back panel forming a pair of overlapping diagonally bordered display pockets therebetween.

3. The folder of claim 2 further comprising a decorative object affixed to the front surface of said outside front panel.

4. The folder of claim 3 wherein said decorative object is removably attached.

5. The folder of claim 4 wherein said outside front panel and said inside front panel each have a coextensive cutout hole adjacent to the mid-point of said first diagonal score line.

6. The folder of claim 5 wherein said decorative object is attached to said folder via a ribbon-like material passing through said cutout holes.

7. The folder of claim 3 wherein said decorative object is a contrastingly colored bookmark in interlocking relation with said inside and outside front panels.

8. The folder of claim 3 wherein said decorative object is a contrastingly colored bookmark in interlocking relation with said outside front panel and said tab back panel.

9. A blank for forming a dual-pocket display folder, the blank comprising:

a) a rectangular inside back panel defined by a first top edge, a bottom score line parallel to the top edge, and first and second side edges transverse of the first top edge and bottom score line;

b) a triangular inside front panel connected to the inside back panel at the bottom score line and further defined by a third side edge and a first diagonal score line;

c) a triangular outside front panel connected to the inside front panel at the first diagonal score line, and further defined by a first bottom edge and a first side score line;

d) a rectangular outside back panel connected to the outside front panel at the first side score line, and further defined by a second side score line parallel to the first side score line and second bottom and second top edges transverse of the first side score line and the second side score line;

e) a triangular tab front panel connected to the outside back panel at the second side score line and further defined by a third bottom edge and a second diagonal score line; and f) a triangular tab back panel connected to the tab front panel at the second diagonal score line and further defined by a fourth bottom edge and a fourth side edge.

10. The blank of claim 9 further comprising a decorative object affixed to the outside surface of said outside front panel.

11. The blank of claim 9 wherein said outside front panel and said inside front panel each have a cutout hole adjacent to said first diagonal score line, said cutout holes being equidistant from said first diagonal score line along a line perpendicular to said first diagonal score line.

12. The blank of claim 9 wherein the bottom score line, first diagonal score line and first side score line are folded to erect the inside back panel between the inside front panel and outside back panel.

13. The blank of claim 12 wherein the second side score line and second diagonal score line are folded to insert the front and back tab panels between the inside front panel and inside back panel.

* * * * *